US008201758B2

(12) United States Patent
Cheng

(10) Patent No.: US 8,201,758 B2
(45) Date of Patent: Jun. 19, 2012

(54) FLUID SPRAYING DEVICE

(75) Inventor: Meng-Feng Cheng, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 371 days.

(21) Appl. No.: 12/549,643

(22) Filed: Aug. 28, 2009

(65) Prior Publication Data

US 2011/0049271 A1 Mar. 3, 2011

(51) Int. Cl.
*B05B 1/08* (2006.01)
*B05B 1/30* (2006.01)
*F15C 3/16* (2006.01)

(52) U.S. Cl. ..... 239/589.1; 239/396; 239/538; 239/540; 137/825

(58) Field of Classification Search ..... 239/390, 239/392, 394, 396, 451, 537, 538, 540, 587.3, 239/587.4, 589.1, 597, DIG. 7; 137/811, 137/813, 825, 833
See application file for complete search history.

(56) References Cited

U.S. PATENT DOCUMENTS 3,741,481 A * 6/1973 Bauer ..... 239/589.1
4,151,955 A * 5/1979 Stouffer ..... 239/11
6,904,626 B1 * 6/2005 Hester et al. ..... 4/541.6

* cited by examiner

*Primary Examiner* — Darren W Gorman

(57) ABSTRACT

A fluid spraying device comprises a fluid oscillator used to oscillate fluid to generate spraying water and including an inlet, at least one power nozzle, an interacting chamber, and an outlet, characterized in that: the fluid oscillator including a first portion and a second portion; a connection of the first and the second portions communicates with the power nozzle to flow fluid through a predetermined traveling position, and the first portion includes the inlet and a section of the power nozzle, and the second portion includes the outlet and another section of the power nozzle, by using an interaction of the first and the second portions, a cross sectional area of the fluid at the connection of the first and the second portions is changed to adjust spraying water from the outlet.

17 Claims, 22 Drawing Sheets

FLUID SPRAYING DEVICE

BACKGROUND OF THE INVENTION

1. Field of the Invention

The present invention relates to a fluid spraying device, and more particularly to a fluid spraying device that includes a fluid oscillator to adjust its flowing amount.

2. Description of the Prior Art

Conventional fluid oscillator disclosed in U.S. Pat. No. 4,151,955 includes a oscillating chamber or an interacting chamber, the oscillating chamber includes an inlet, an outlet, and a triangle stop member in the chamber, the stop member includes two vortex streets formed in the chamber, such that as fluid flows into the chamber, the vortex streets on two sides of the stop member generate changeable fluid, and as the fluid flows out of the outlet, a circulating and oscillating fluid generates, thus generating different modes of fluid or spraying water from the outlet.

Another conventional fluid oscillator disclosed in U.S. Pat. No. 4,052,002 includes two stop members in a chamber to form an interacting zone between the stop members and a channel, and a power nozzle is fixed in an inlet and has a decreased cross-sectional area to accelerate fluid to flow into the chamber, thereby obtaining different modes of fluid or spraying water.

U.S. Pat. No. 7,472,848 discloses a fluid oscillator including two power nozzles, and US Pat. No. 2005/0087633 discloses a fluid oscillator including three power nozzles.

WO2007/044354 discloses a fluid oscillator including a housing to be used in showering head.

WO2007/044354 discloses a fluid spraying assembly including a fluid oscillator to lower fluid to save water. However, above-mentioned fluid oscillators generate fixed flowing speed and spraying water that can not be adjusted freely based on demand.

The present invention has arisen to mitigate and/or obviate the afore-described disadvantages.

SUMMARY OF THE INVENTION

The primary object of the present invention is to provide a fluid spraying device which can adjust spraying water to save water.

A fluid spraying device in accordance with the present invention comprises a fluid oscillator being used to oscillate fluid to generate spraying water and including:

an inlet to flow fluid into the fluid oscillator;

at least one power nozzle communicating with the inlet to accelerate the speed of the fluid from the inlet;

an interacting chamber communicating with the power nozzle to flow the fluid from the power nozzle and further flow the fluid outward to be oscillated;

an outlet being in communication with the chamber to oscillate the fluid from the chamber to generate spraying water, characterized in that:

the fluid oscillator includes a first portion and a second portion; a connection of the first and the second portions passes through the power nozzle to flow fluid through a predetermined traveling position, and the first portion includes the inlet and a section of the power nozzle, the second portion includes the outlet and another section of the power nozzle, by using an interaction of the first and the second portions, a cross sectional area of the fluid at the connection of the first and the second portions is changed to adjust spraying water from the outlet;

wherein the first and the second portions move relative to each other between a normal position and at least one adjusting position; at the normal position, a first flowing zone of the first portion and a second flowing zone of the second portion align with each other so that a cross sectional area of the fluid at the connection of the first and the second portions is largest; at the adjusting position, the first flowing zone of the first portion and the second flowing zone of the second portion cross with each other so that the cross sectional area of the fluid at the connection of the first and the second portions is less than that of the fluid at the connection of the first and the second portions at the normal position;

wherein the first portion includes at least one T-shaped slide block extending outward from a bottom end thereof, and the second portion includes at least one T-slot arranged on a top end thereof so that the slide block moves along the T-slot;

wherein a cross section of the power nozzle is formed in a rectangle shape;

wherein the first portion includes a joint disposed on a top end thereof to screw with an outputting pipe;

the fluid oscillator further including a housing, a cover, and a connecting head, wherein the housing includes a passageway communicating with a central portion of a bottom wall thereof, the cover is fixed on a lower side of the housing to be operated to rotate, and includes a hollow opening defined on a central portion thereof, the connecting head is installed to a top end of the housing to couple with the outputting pipe and to flow fluid to the housing, the fluid oscillator is installed between the housing and the cover, and the inlet communicates with the housing, the outlet communicates with an external environment through the hollow opening, the second portion connects with the housing, and the first portion couples with the cover to be actuated by the cover to rotate along the second portion.

DETAILED DESCRIPTION OF THE PREFERRED EMBODIMENTS

Figure 1:
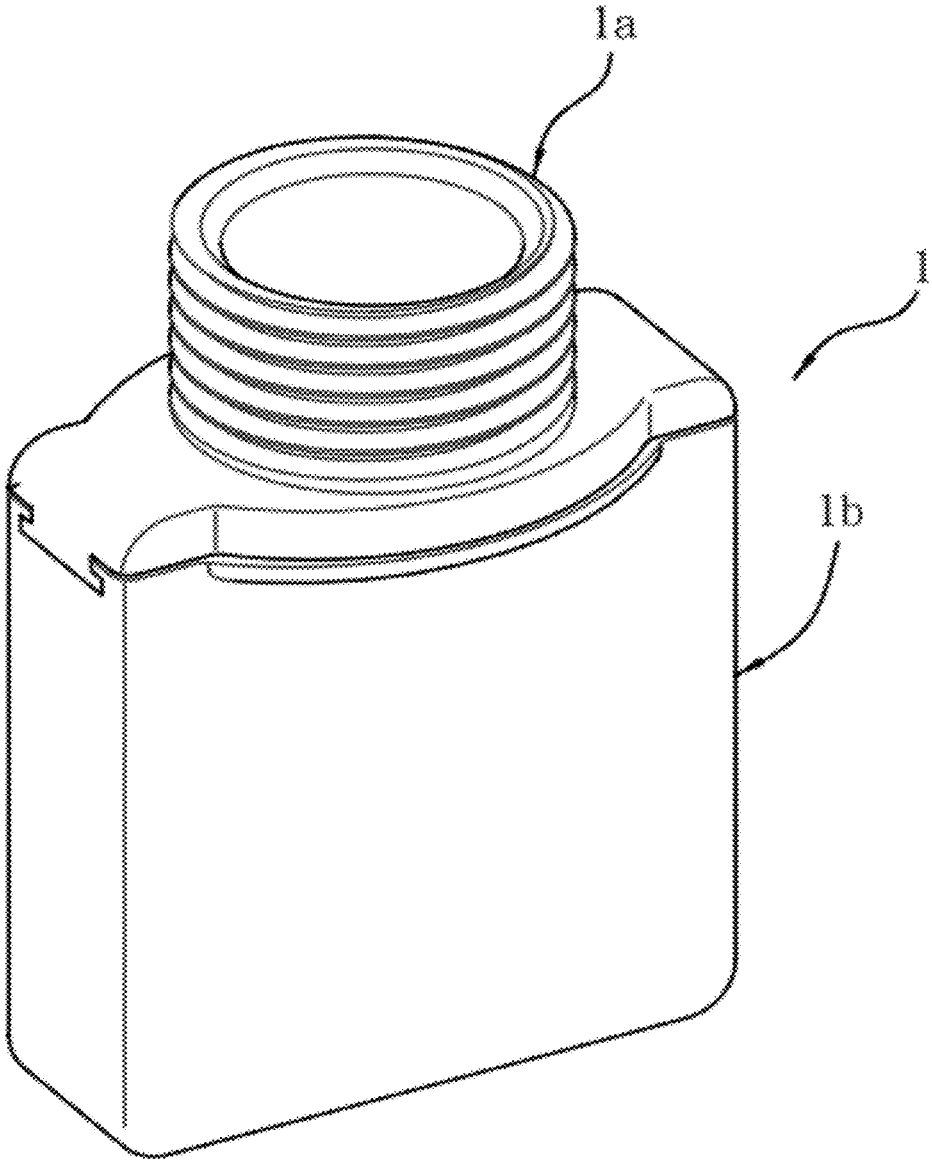
FIG. 1 is a perspective view showing the assembly of a fluid spraying device in accordance with a first embodiment of the present invention.
Figure 2:
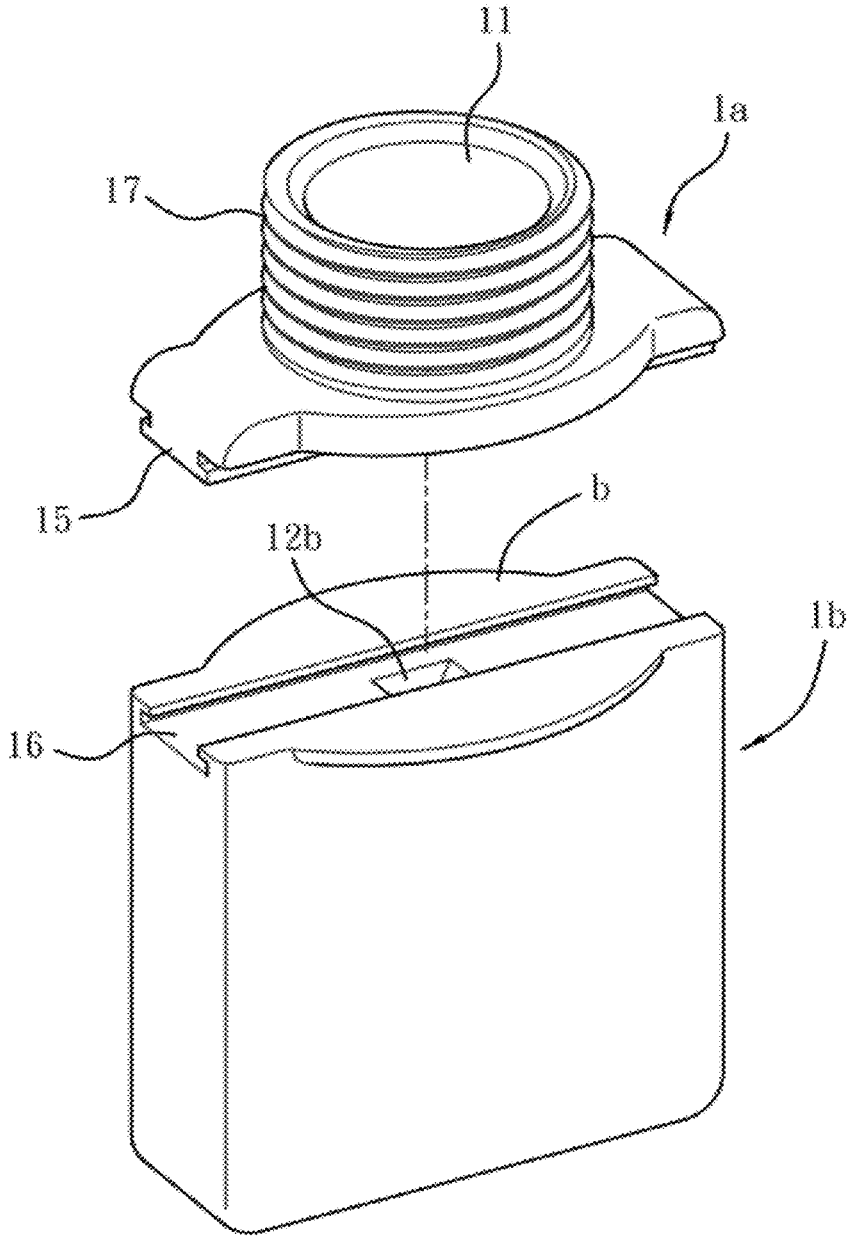
FIG. 2 is a perspective view showing the exploded components of the fluid spraying device in accordance with the first embodiment of the present invention.

The present invention will be clearer from the following description when viewed together with the accompanying drawings, which show, for purpose of illustrations only, the preferred embodiment in accordance with the present invention.

Figure 3:
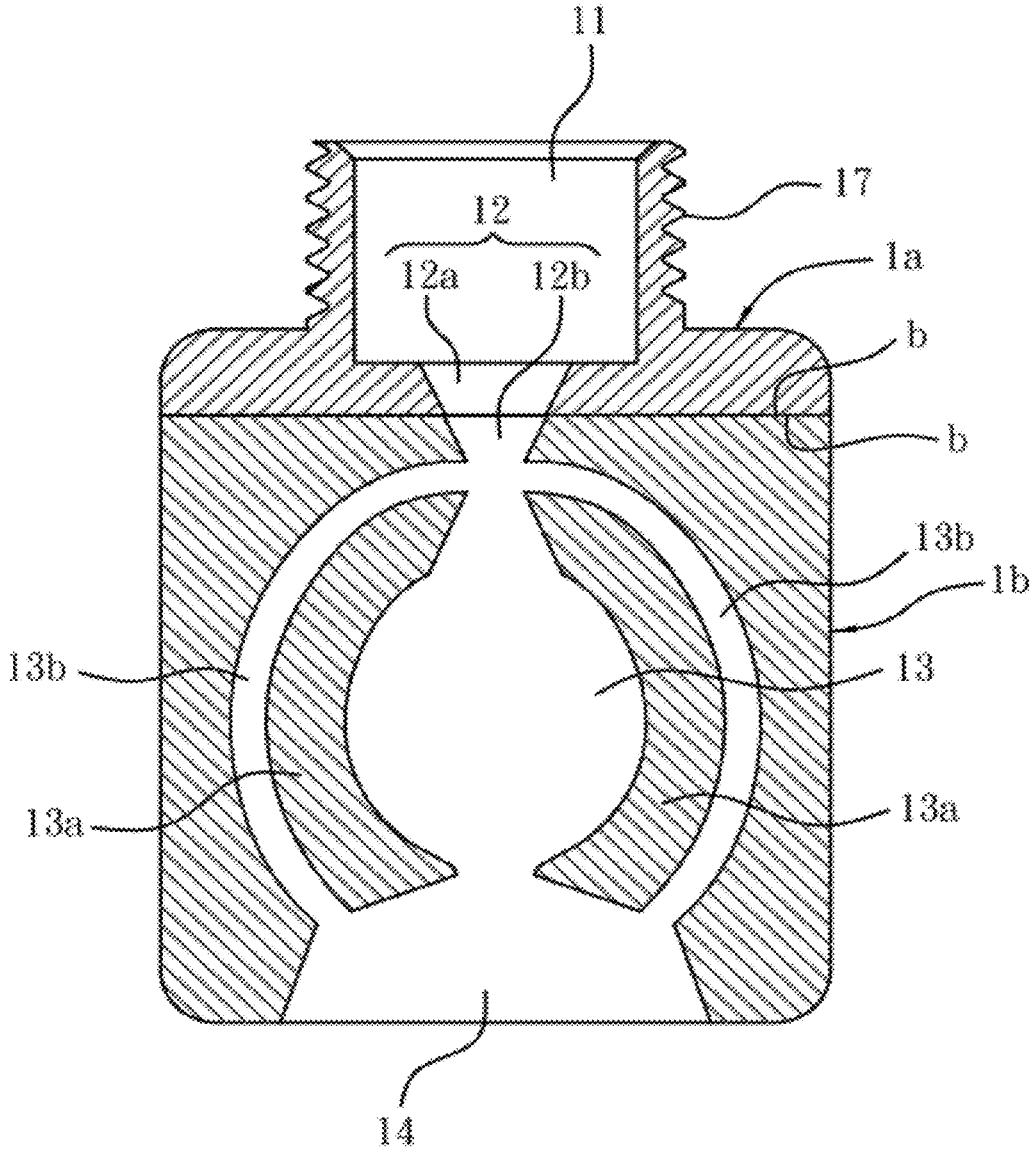
FIG. 3 is a cross sectional view showing the assembly of the fluid spraying device in accordance with the first embodiment of the present invention.
Figure 4:
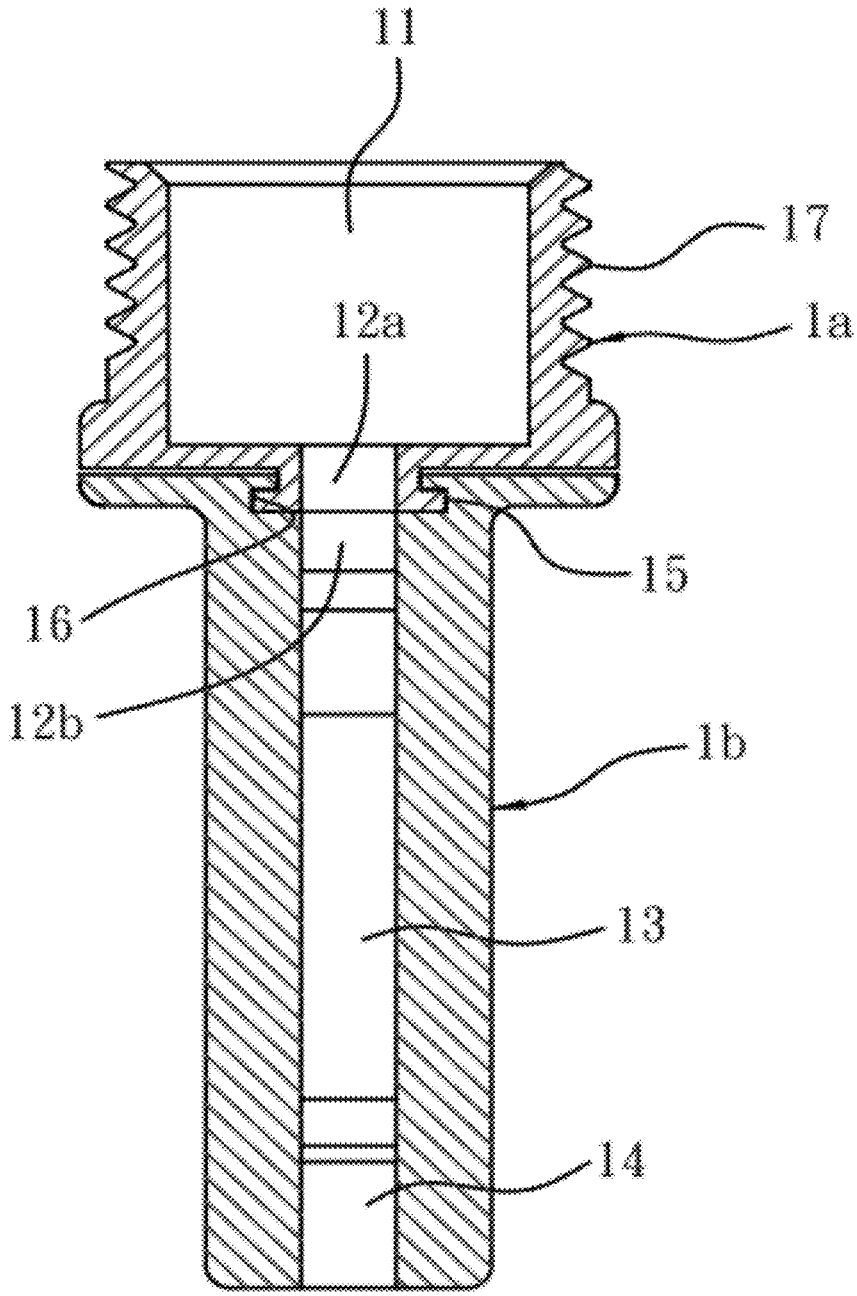
FIG. 4 is another perspective view showing the assembly of the fluid spraying device in accordance with the first embodiment of the present invention.

Referring to FIGS. 1-4, a fluid spraying device according to a first embodiment of the present invention comprises a fluid oscillator 1 being used to oscillate fluid to generate spraying water and including:

an inlet 11 to flow fluid into the fluid oscillator 1;

a power nozzle 12 communicating with the inlet 11 to accelerate the speed of the fluid from the inlet 11;

an interacting chamber 13 or oscillating chamber communicating with the power nozzle 12 to flow the fluid from the power nozzle 12 and further flow the fluid outward to be oscillated; the chamber 13 including two symmetrical stop members 13*a*, and each stop member 13*a* including two channels 13*b* formed on two sides thereof respectively, because the stop member 13*a* and the chamber 13 are well known, further structures thereof are omitted;

an outlet 14 being in communication with the chamber 13 to oscillate the fluid from the chamber 13 to generate spraying water. An improvement of the present invention comprises:

the fluid oscillator 1 including a first portion 1*a* and a second portion 1*b*, each having a connecting plane b. As illustrated in FIG. 3, the connecting planes b of the first and the second portions 1*a*, 1*b* pass through a middle section of the power nozzle 12, and the first portion 1*a* includes the inlet 11 and a first flowing zone 12*a* above the connecting plane b thereof, and the second portion 1*b* includes the outlet 14 and the second flowing zone 12*b* below the connecting plane b thereof, and includes the chamber 13, the stop member 13*a*, and the channel 13.

The first and the second portions 1*a* and 1*b* move relative to each other linearly. The first portion 1*a* includes a T-shaped slide block 15 extending outward from a bottom end of the connecting plane b thereof, and the second portion 1*b* includes a T-slot 16 arranged on a top end of the connecting plane b thereof so that the slide block 15 moves along the T-slot 16 to be positioned, hence the first and the second portions 1*a*, 1*b* are operated to move laterally in relation to each other as shown in FIG. 5.

Further referring to FIG. 3, the first and the second portions 1*a*, 1*b* are located at a normal position, and the first flowing zone 12*a* of the first portion 1*a* aligns with the second flowing zone 12*b* of the second portion 1*b* to form a downward decreased path having a rectangle cross section.

Figure 5:
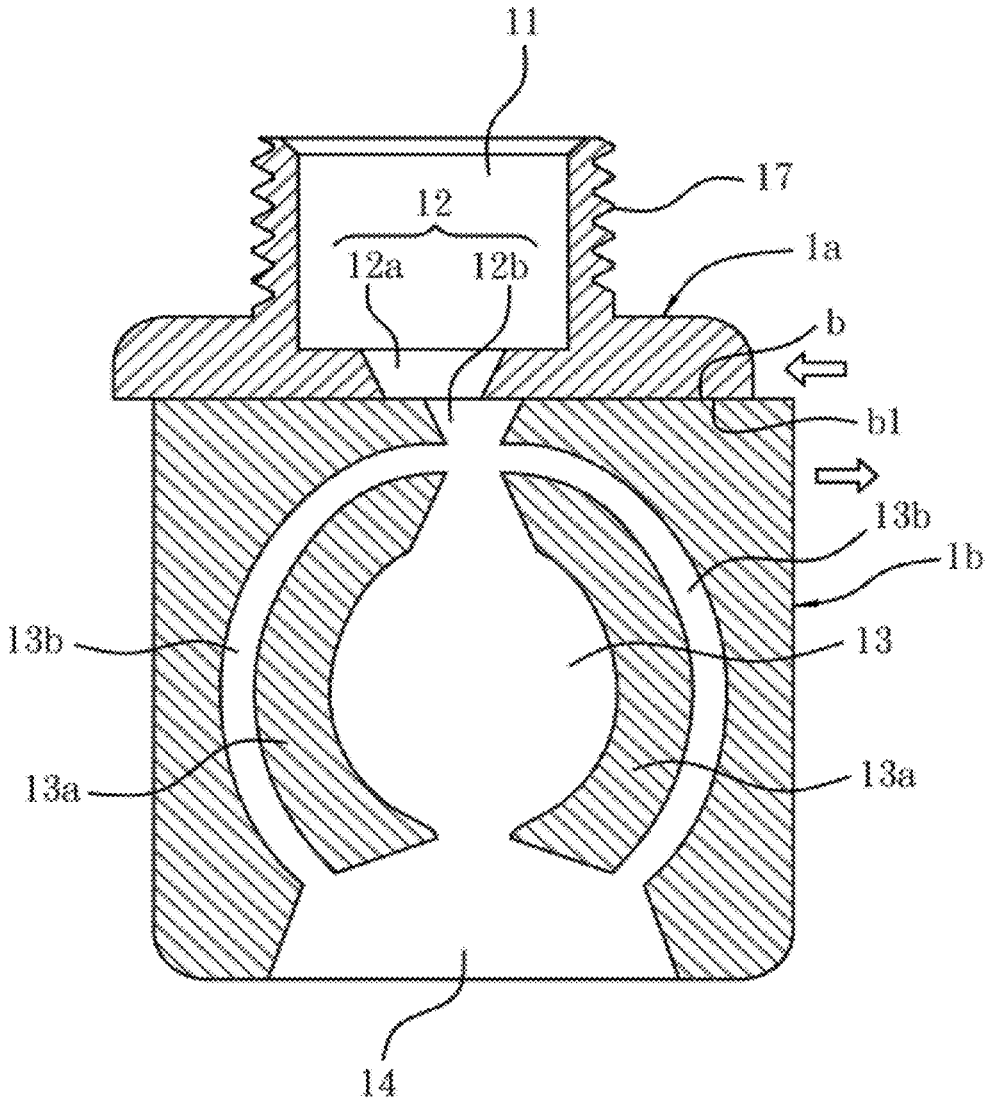
FIG. 5 is a cross sectional view showing a first portion and a second portion of the fluid spraying device moving laterally relative to each other in accordance with the first embodiment of the present invention.
Figure 6:
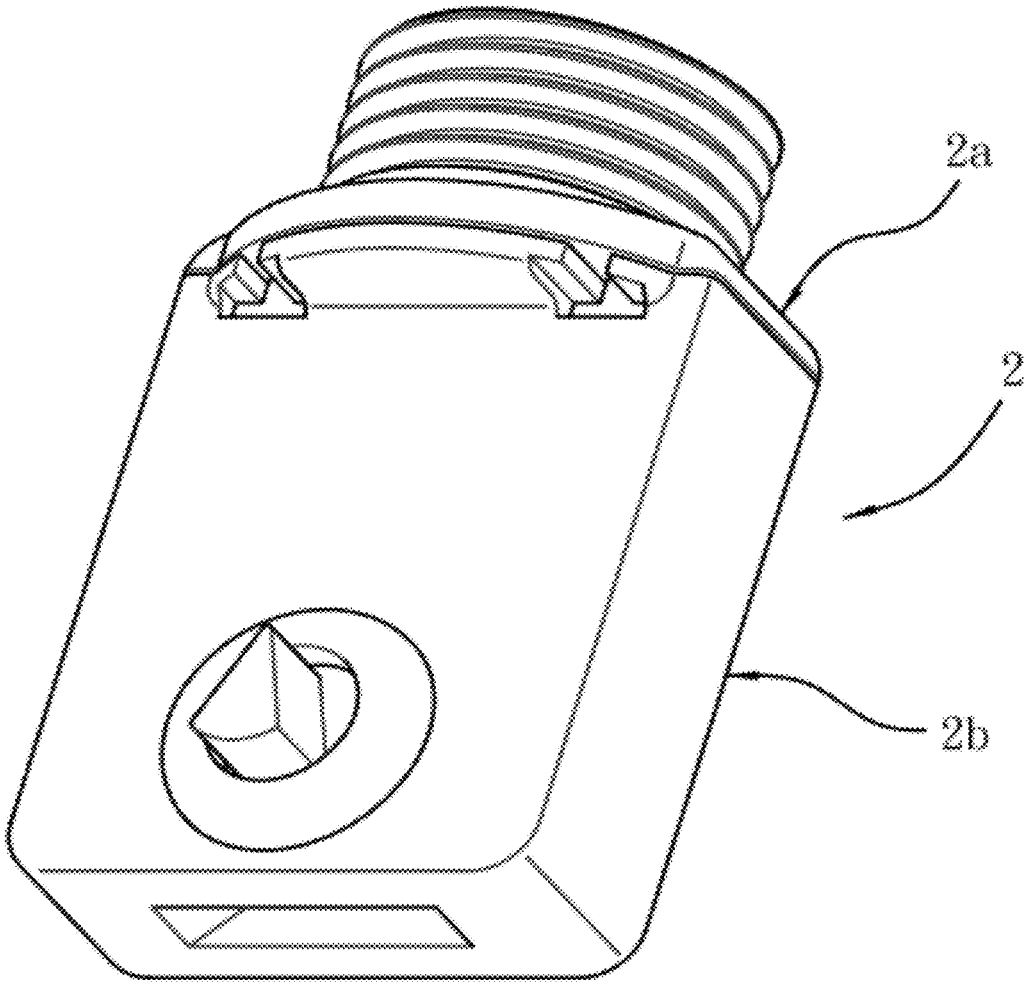
FIG. 6 is a perspective view showing the assembly of a fluid spraying device in accordance with a second embodiment of the present invention.
Figure 7:
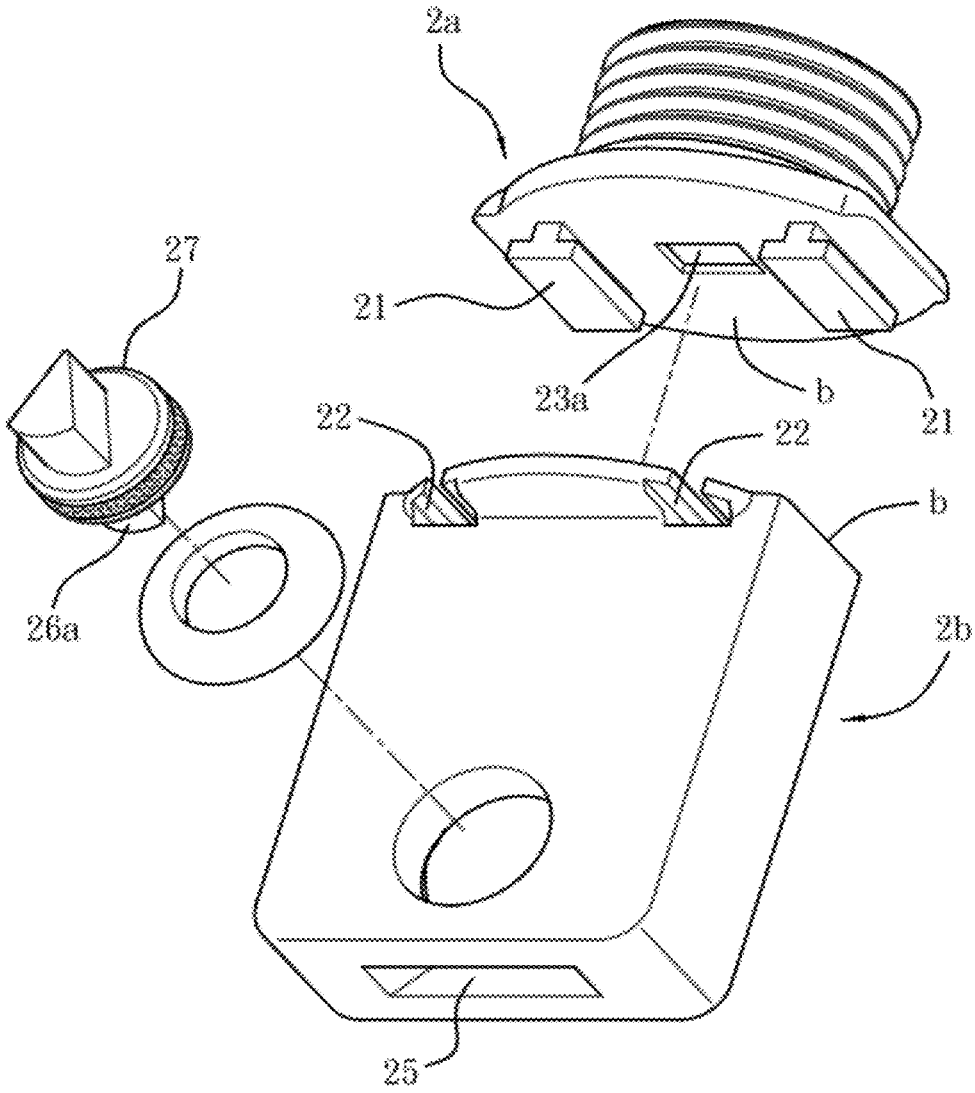
FIG. 7 is a perspective view showing the exploded components of the fluid spraying device in accordance with the second embodiment of the present invention.
Figure 8:
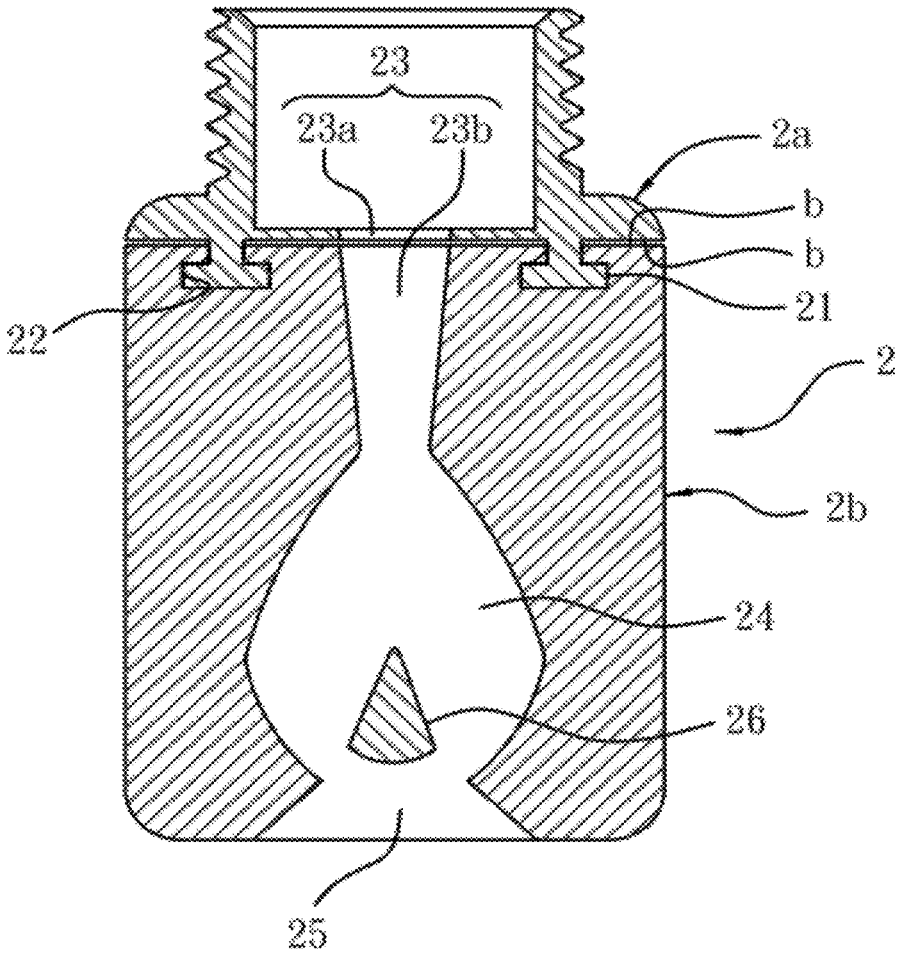
FIG. 8 is a cross sectional view showing the assembly of the fluid spraying device in accordance with the second embodiment of the present invention.
Figure 9:
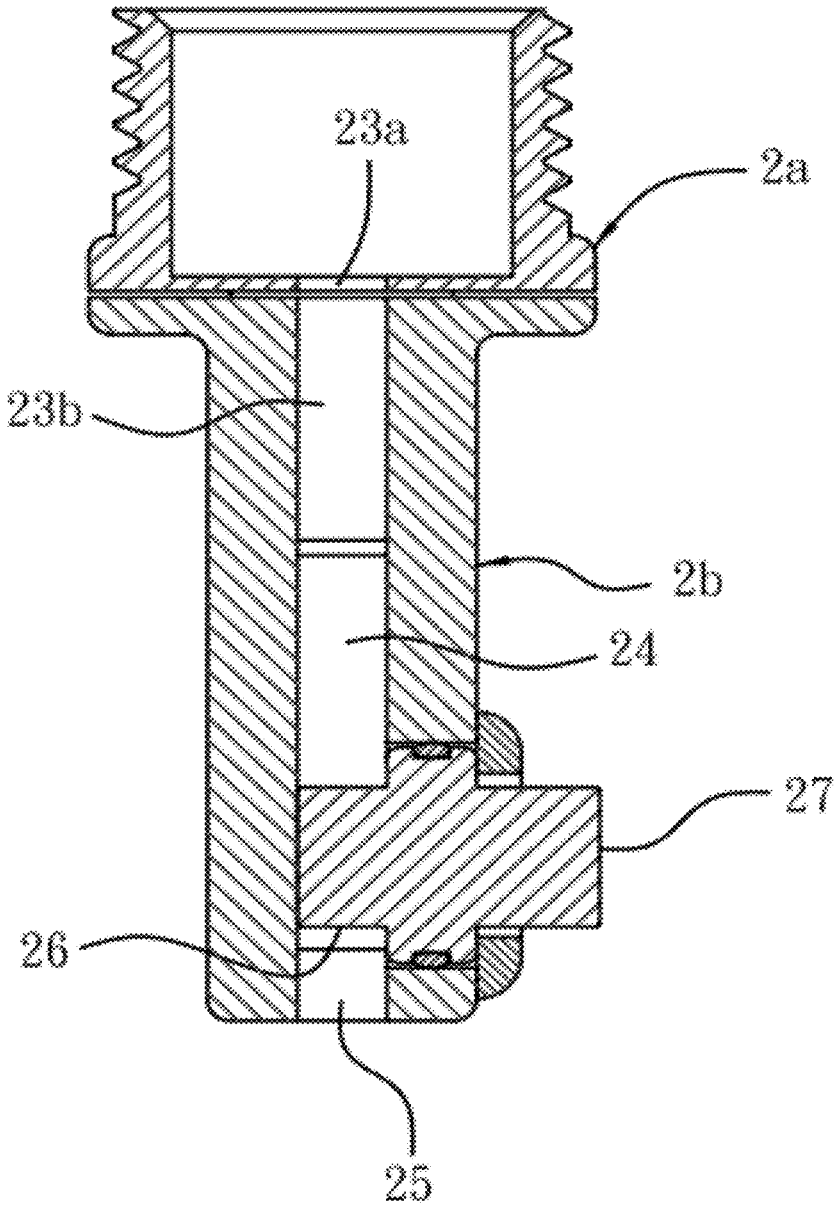
FIG. 9 is another perspective view showing the assembly of the fluid spraying device in accordance with the second embodiment of the present invention.
Figure 10:
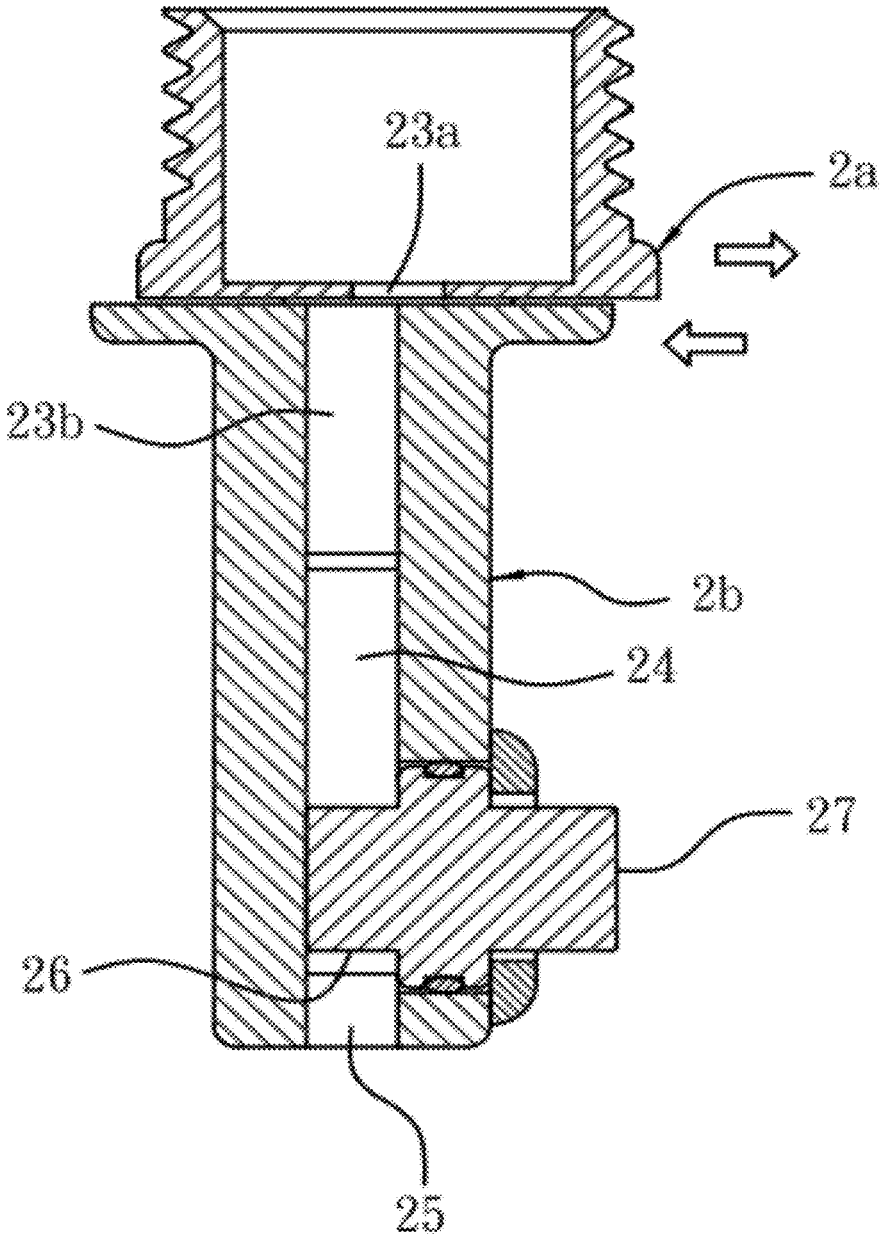
FIG. 10 is a cross sectional view showing a first portion and a second portion of the fluid spraying device moving longitudinally relative to each other in accordance with the second embodiment of the present invention.

In operation as shown in FIG. 5, the first and the second portions 1*a* and 1*b* slide to a predetermined position of an adjusting place so that the power nozzle 12 is located at the first flowing zone 12*a* of the first portion 1*a* to cross with the second flowing zone 12*b* of the second portion 1*b* so as to change a cross sectional area of the fluid at a connection of the first and the second portions 1*a*, 1*b*. If the cross sectional area denotes a variable parameter A, as the cross sectional area is located at a normal position, A becomes biggest. Yet as the cross sectional area is at an adjusting position to be far away from the normal position gradually, A becomes less. In other words, at the normal position, because many fluid flows through the power nozzle 12, the amount of the spraying water from the outlet 14 of the fluid oscillator 1 is largest, and at the adjusting position, because less fluid passes though the power nozzle 12, the amount of the spraying water from the outlet 14 of the fluid oscillator 1 becomes less to obtain water-saving effect.

Furthermore, the cross sectional area A is fixed at a certain traveling position of the power nozzle 12 so that the flowing speed is not be lowered but the flowing amount is decreased to oscillate fluid to spray water from the outlet 14 and to adjust flowing amount.

The fluid oscillator 1 includes a joint 17 disposed on a top end of the first portion 1*a* to screw with various types of outputting pipes.

As illustrated in FIGS. 6-9, the fluid oscillator 2 according to a second embodiment of the present invention comprises a first portion 2*a* including a connecting plane b fixed on a bottom end thereof and having two lengthwise T-shaped slide blocks 21 extending outward from the connecting plane 6. The fluid oscillator 2 also comprises a second portion 2*b* including a connecting plane b mounted on a top end thereof and having two lengthwise T-slots 22 to retain the slide blocks 21, such that the first and the second portions 2*a*, 2*b* are forced to slide linearly relative to each other. As illustrated in FIG.

10, a power nozzle 23 is located in a first flowing zone 23*a* of the first portion 2*a* so as to cross with a second flowing zone 23*b* of the second portion 2*b*, hence the first and the second portions 2*a*, 2*b* overlap and form a cross sectional area A to be adjusted to flow fluid.

The fluid oscillator 2 includes a triangle stop member 26 to replace the two symmetrical stop members 13*a* of the fluid oscillator 1 and proximate to an inlet 25, therefore the stop member 26 is assembled behind the fluid oscillator 2 by using a coupling member 27, and includes a projection 26*a* relative to a chamber 24, because the stop member 26 and the chamber 24 are well known, further description is omitted.

Figure 11:
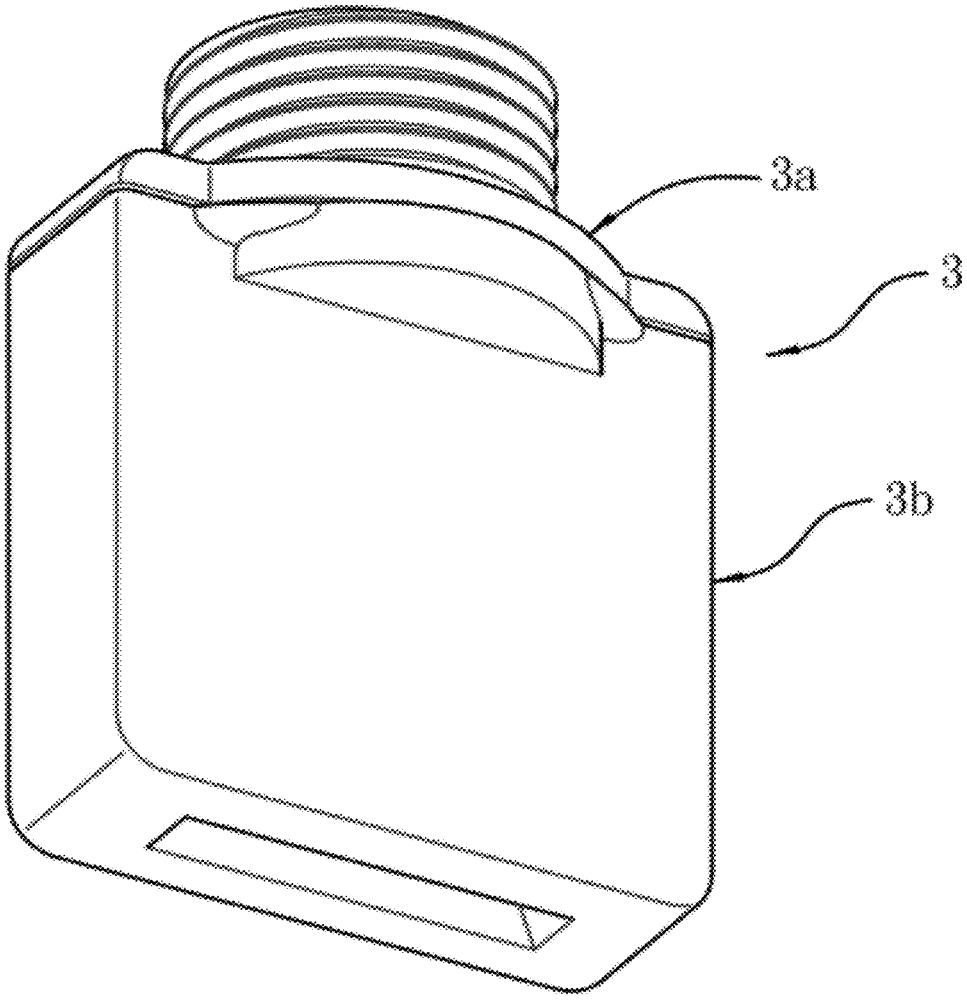
FIG. 11 is a perspective view showing the assembly of a fluid spraying device in accordance with a third embodiment of the present invention.
Figure 12:
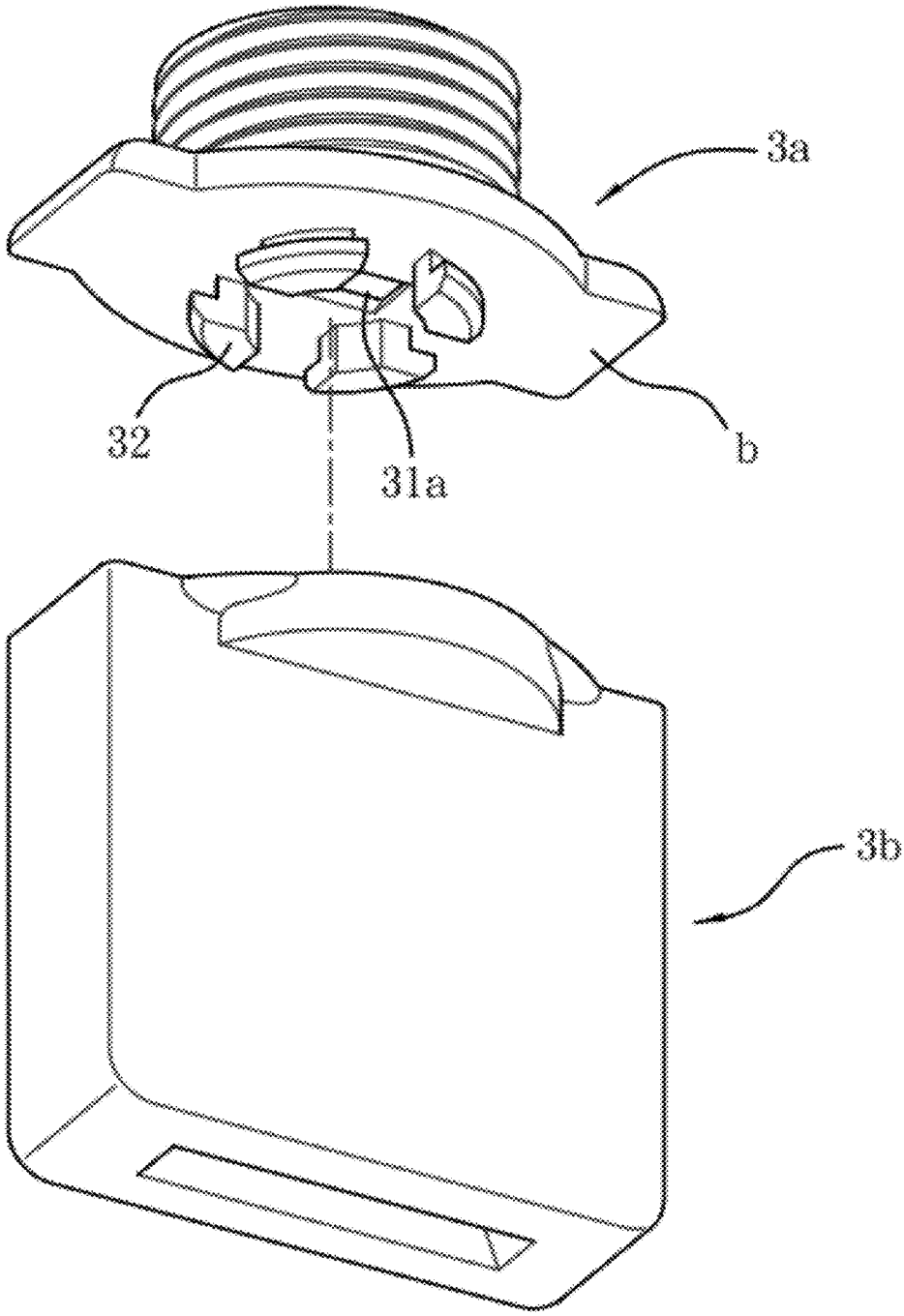
FIG. 12 is a perspective view showing the exploded components of the fluid spraying device in accordance with the third embodiment of the present invention.
Figure 13:
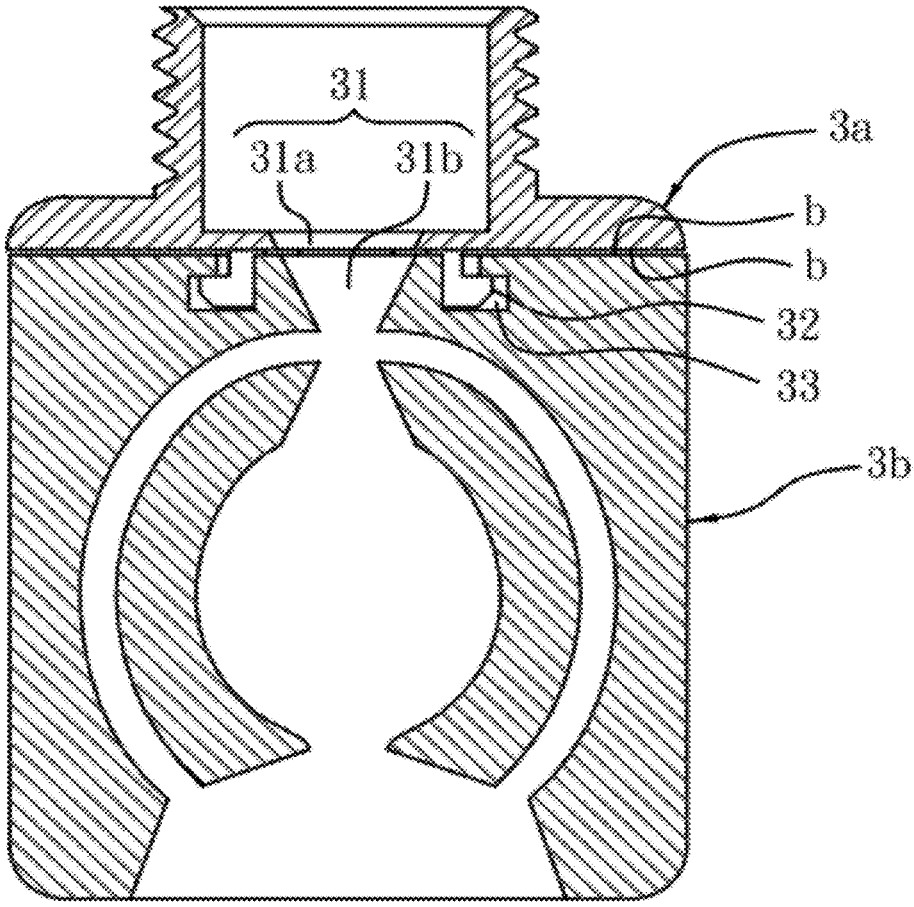
FIG. 13 is a cross sectional view showing the assembly of the fluid spraying device in accordance with the third embodiment of the present invention.
Figure 14:
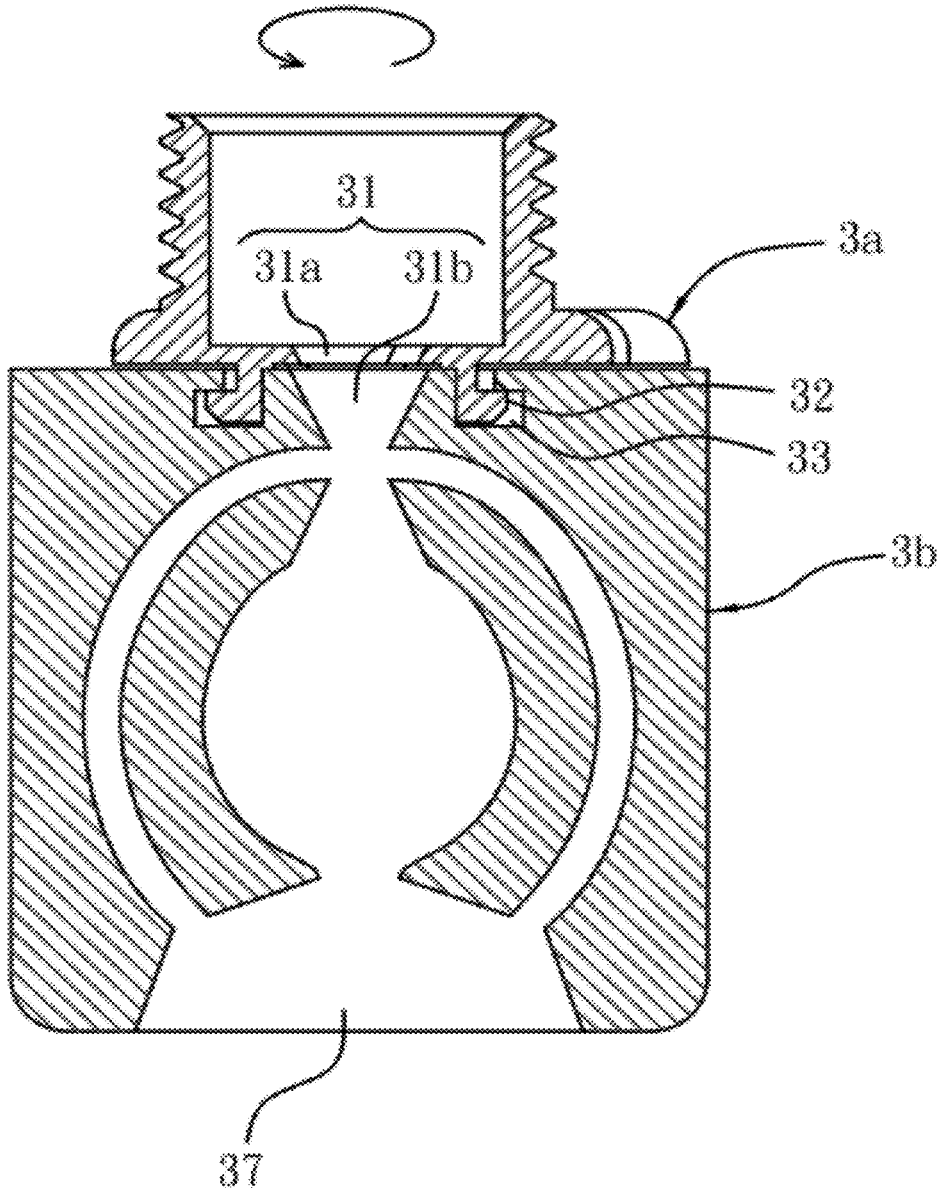
FIG. 14 is a cross sectional view showing a first portion and a second portion of the fluid spraying device rotating relative to each other in accordance with the third embodiment of the present invention.
Figure 15:
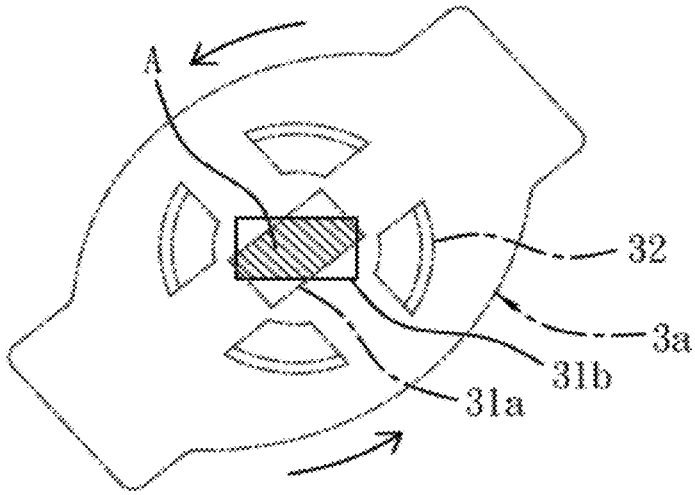
FIG. 15 is a top plan view showing a first and a second flowing zones overlapping each other, wherein an overlapped portion of the first and the second flowing zones is a cross sectional area A.

With reference to FIGS. 11-13, a fluid oscillator 3 according to a third embodiment of the present invention is rotated and comprises a first portion 3*a* including a connecting plane b disposed on a bottom thereof and having a power nozzle 31 formed on the connecting plane b and having four L-shaped sliding blocks 32 attached around the power nozzle 31. The fluid oscillator 3 further comprises a second portion 3*b* including a connecting plane b mounted on a top end thereof and having an annular slidable slot 33 formed on the connecting plane b to retain the sliding blocks 32, such that the first and the second portions 3*a*, 3*b* are forced to rotate. As shown in FIG. 14, a cross sectional area A of a power nozzle 31 is adjusted, and as illustrated in FIG. 15, as the first and second portion 3*a*, 3*b* are rotated from a normal position to a suitable adjusting position, the power nozzle 31 is located in a first flowing zone 31*a* of the power nozzle 31 and crosses with a second flowing zone 31*b* of the second portion 3*b*, and then the first and the second flowing zones 31*a*, 31*b* overlap each other, wherein an overlapped portion of the first and the second flowing zones 31*a*, 31*b* is a cross sectional area A shown in the FIG. 15. It is to be noted that the cross sectional area A is less than that of fluid at the normal position.

To increase a sealing effect, between the first portions 1*a*, 2*a*, and 3*a* and the second portions 1*b*, 2*b*, 3*b* are provided with a sealing element, such as an O-ring or an anti-leak pad.

To adjust flowing amount freely, the shape of the power nozzles 12, 23, 31 are formed in various shapes, such as a rectangle, triangle, and ellipse.

Figure 16:
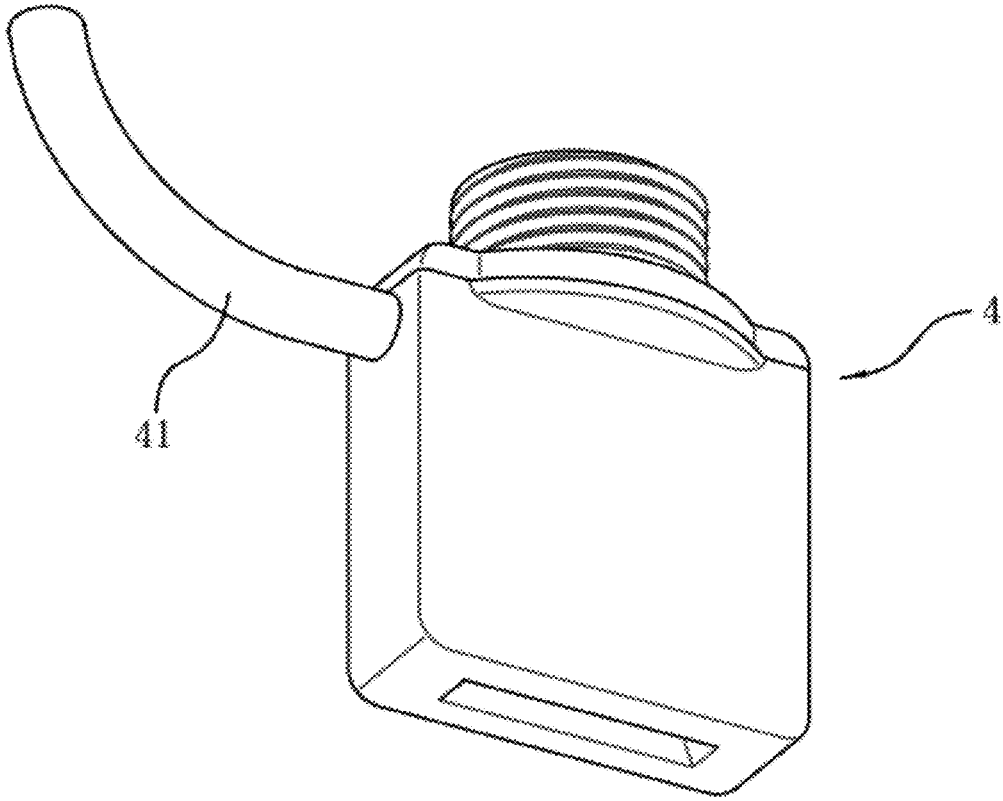
FIG. 16 is a perspective view showing the assembly of a fluid spraying device in accordance with a fourth embodiment of the present invention.
Figure 17:
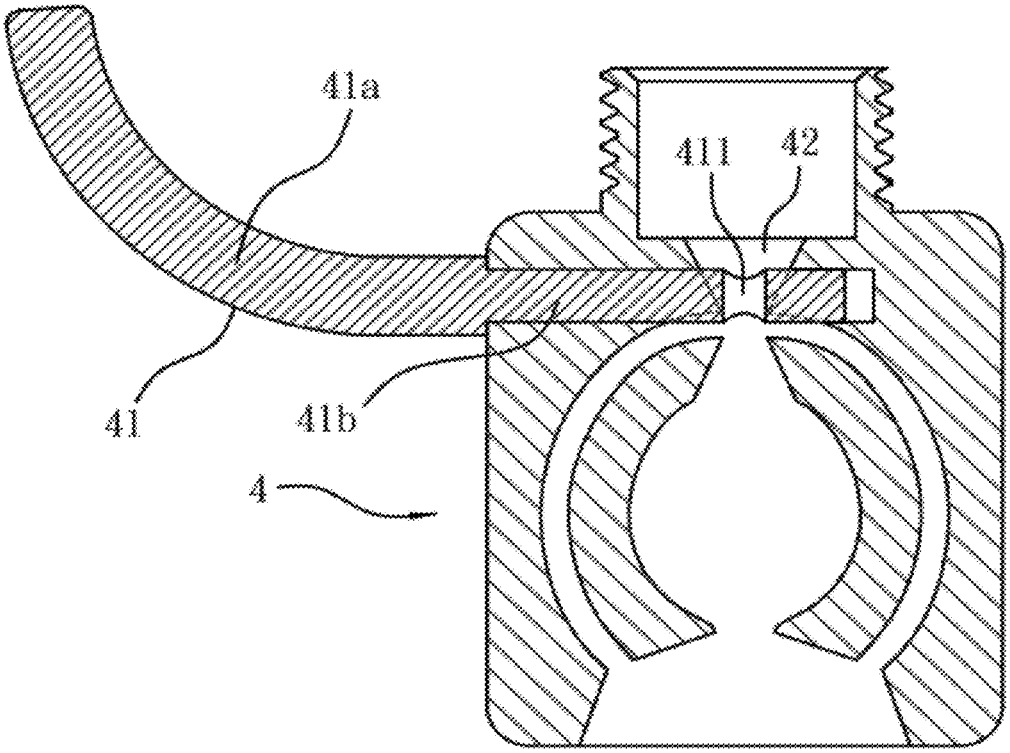
FIG. 17 is a cross sectional view showing the assembly of the fluid spraying device in accordance with the fourth embodiment of the present invention.
Figure 18:
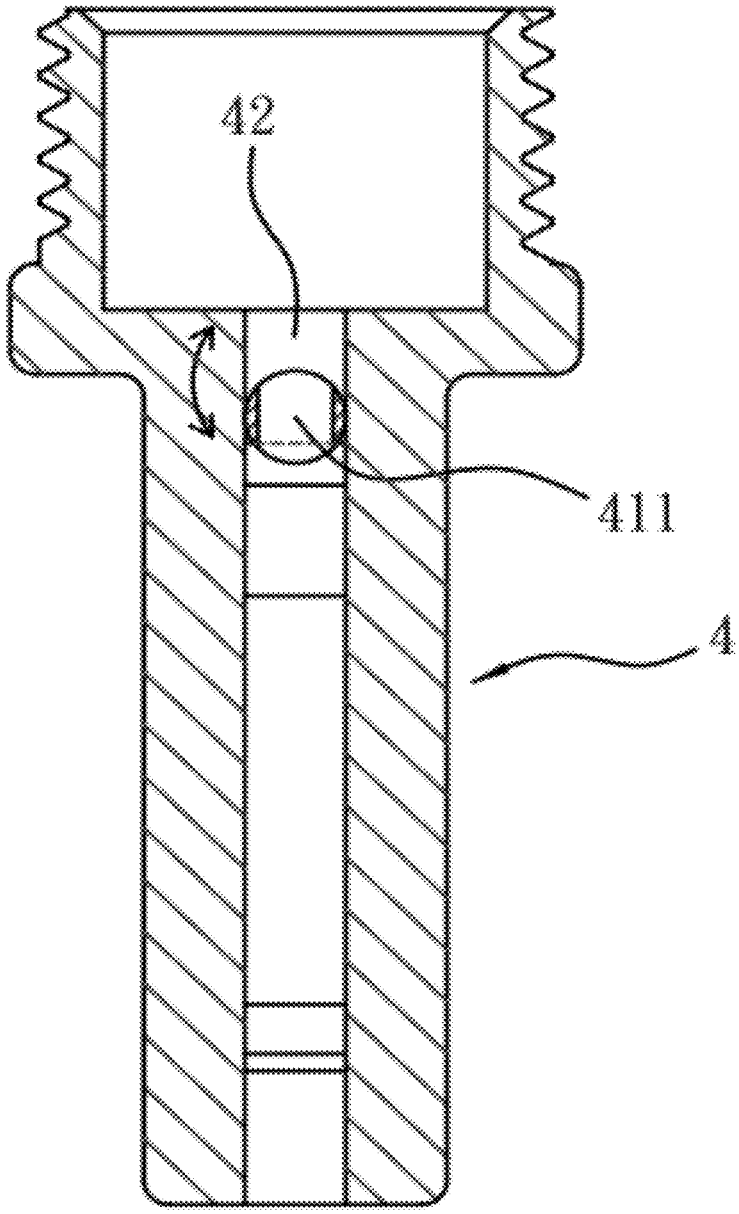
FIG. 18 is another perspective view showing the assembly of the fluid spraying device in accordance with the fourth embodiment of the present invention.
Figure 19:
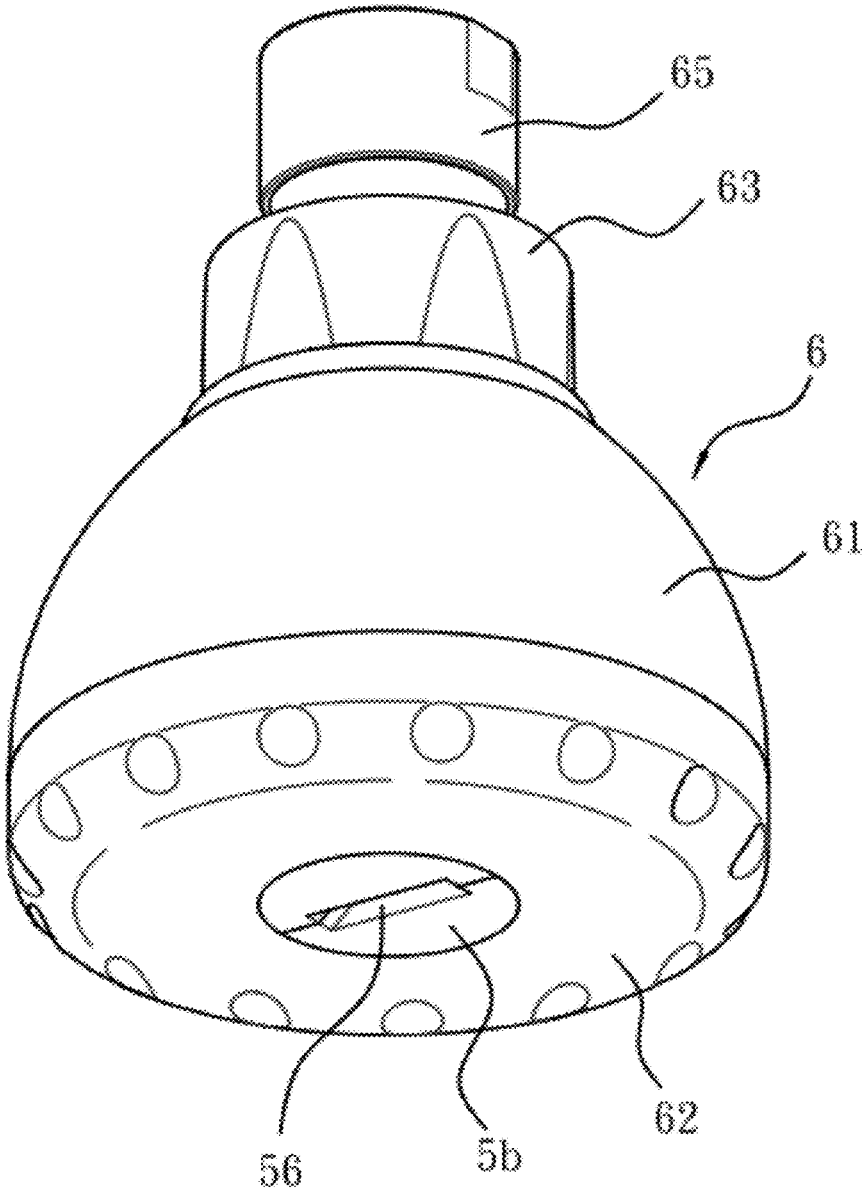
FIG. 19 is a perspective view showing the assembly of a fluid spraying device in accordance with a fifth embodiment of the present invention.

With reference to FIGS. 16-18, a fluid oscillator 4 according to a fourth embodiment of the present invention comprises an adjustable shaft 41 including a inserting section 41*b* to be inserted to the fluid oscillator 4 and passes through a predetermined position of a power nozzle 42 and including an operating section 41*a* extending outward. The inserting section 41*b* includes a through hole 411 adjacent to a distal end thereof in relation to the power nozzle 42 so that the amount of fluid passing through the power nozzle 42 is largest. When the operating section 41*a* of the adjustable shaft 41 is rotated toward a predetermined direction, the through hole 411 of the inserting section 41*b* is actuated to move to not align with the power nozzle 42, thereby adjusting fluid amount.

Furthermore, as the adjustable shaft 41 is pushed toward the power nozzle 42, a larger stopping area in the power nozzle 42 is generated, and as the adjustable shaft 41 is pushed outward to be far way the power nozzle 42, a smaller stopping area in the power nozzle 42 is generated, so as to change a cross sectional area of the fluid.

Referring to FIGS. 19-24, a fluid oscillator 5 according to a fifth embodiment of the present invention is applied in a jetted flowing device of a shower head, and comprises a first portion 5*a* and a second portion 5*b*.

Figure 20:
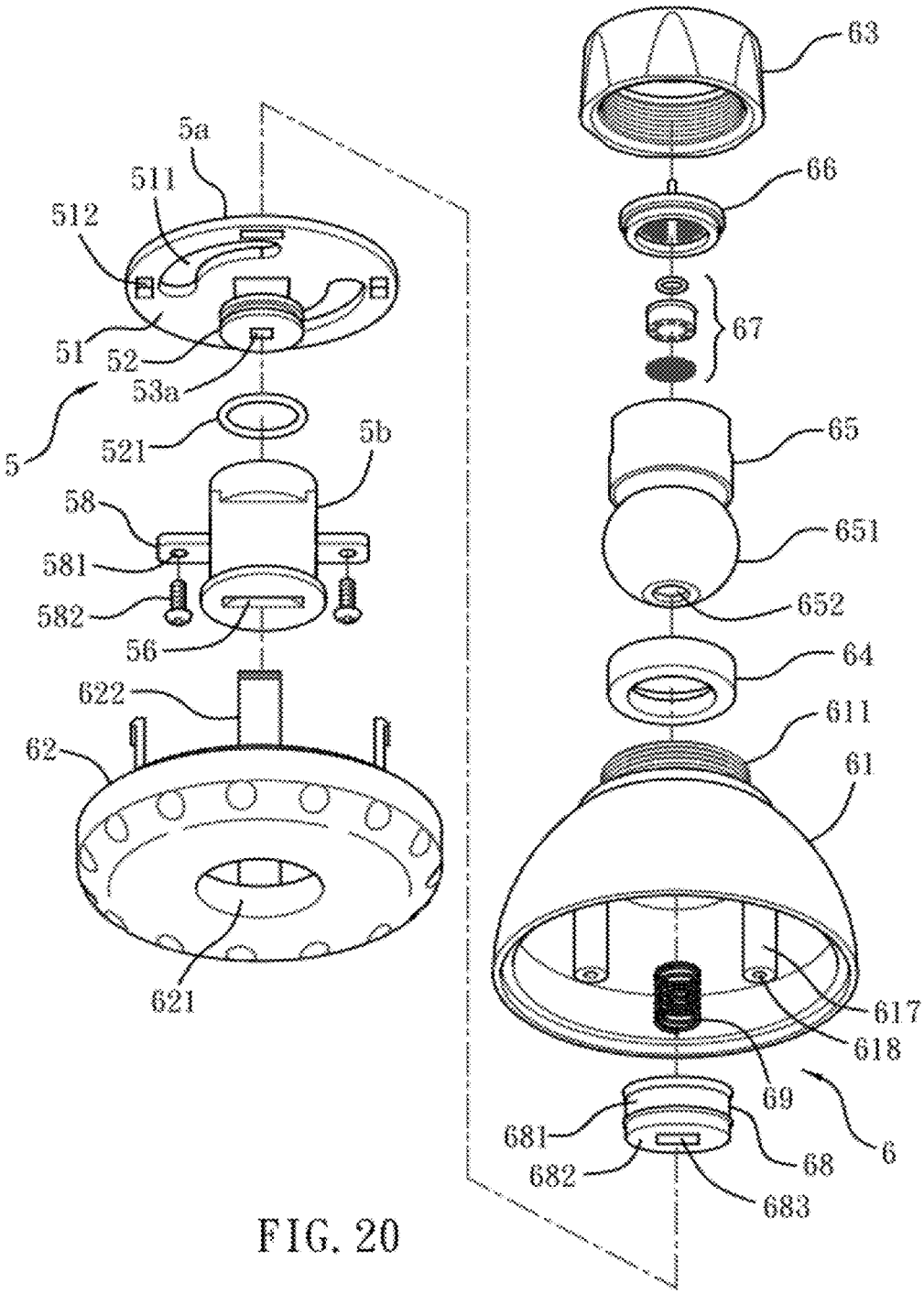
FIG. 20 is a perspective view showing the exploded components of the fluid spraying device in accordance with the fifth embodiment of the present invention.
Figure 21:
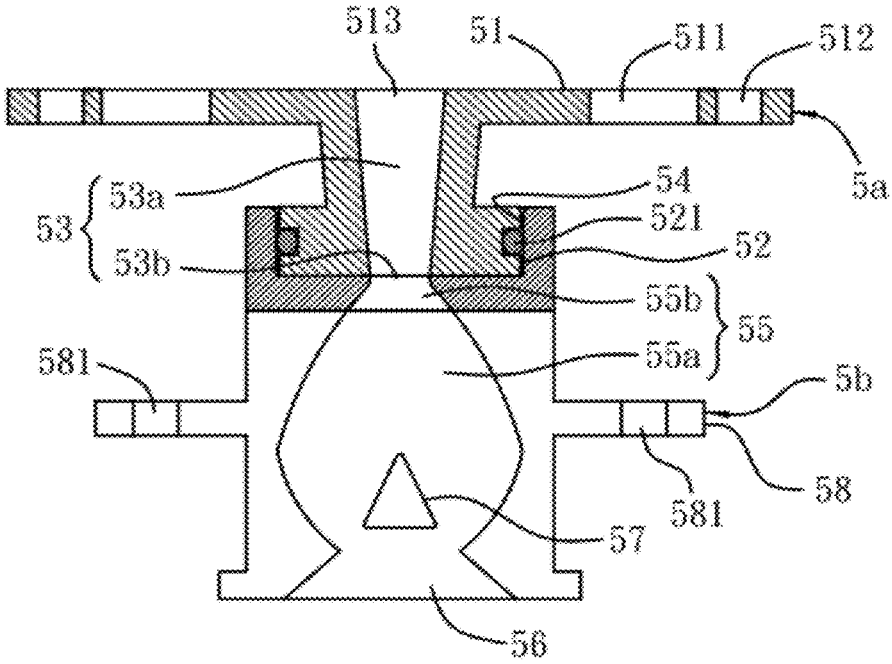
FIG. 21 is a cross sectional view showing the assembly of the fluid spraying device in accordance with the fifth embodiment of the present invention.

As shown in FIGS. 20 and 21, the first portion 5*a* includes a circular disc 51 having two arcuate notches 511 symmetrical to each other and four retaining bores 512 located around the arcuate notches 511, and includes a positioning peg 52 extending from a bottom end thereof and having a sealing ring 521 fitted around a rim of the positioning peg 52, and includes an inlet 513 formed on a top end thereof and having a power nozzle 53 extending inward from the inlet 513 and having a first channel 53*a*.

Figure 22:
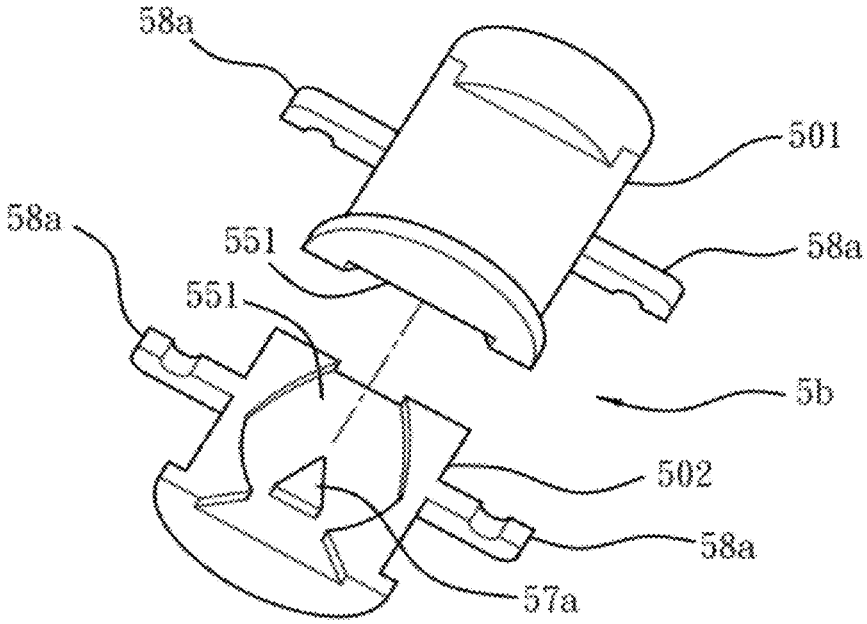
FIG. 22 is a perspective view showing the exploded components of a second portion of the fluid spraying device in accordance with the fifth embodiment of the present invention.

With reference to FIG. 22, the second portion 5*b* is comprised of a first part 501 and a second part 502, the first part 501 includes an engaging recess 54 arranged on a top end thereof to engage the positioning peg 52 of the first portion 5*a* tightly, and the positioning peg 52 is located in the engaging recess 54 to rotate.

The first and the second parts 501, 502 include two recessed surfaces 551 formed on inner walls thereof respectively to define a chamber 55 with a first space 55*a* and an outlet 56, and a recessed surface 551 of the second part 502 includes a triangle projection 57*a* proximate to the outlet 56 to abut against a recessed surface 551 of the first part 501, so as to define a stop member 57 located at the chamber 55. The first part 501 includes a second channel 53*b* aligning with the first channel 53*a* to form the power nozzle 53.

The second channel 53*b* communicates with a second space 55*b* so that the first space 55*a* and the second space 55*b* form a complete chamber 55.

The first part 501 and the second part 502 include two ribs 58*a* disposed on two outer sides thereof respectively, and the first and the second parts 501, 502 are assembled to generate a supporting member 58 having two through holes 581.

Figure 23:
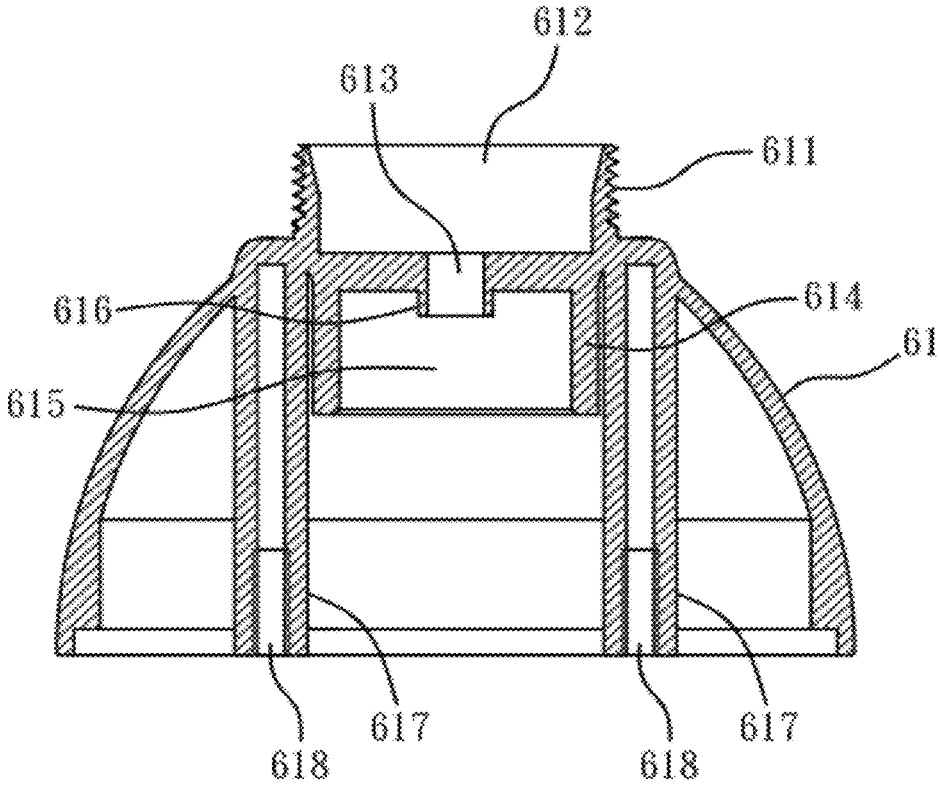
FIG. 23 is a cross sectional view showing the assembly of a housing of the fluid spraying device in accordance with the fifth embodiment of the present invention.
Figure 24:
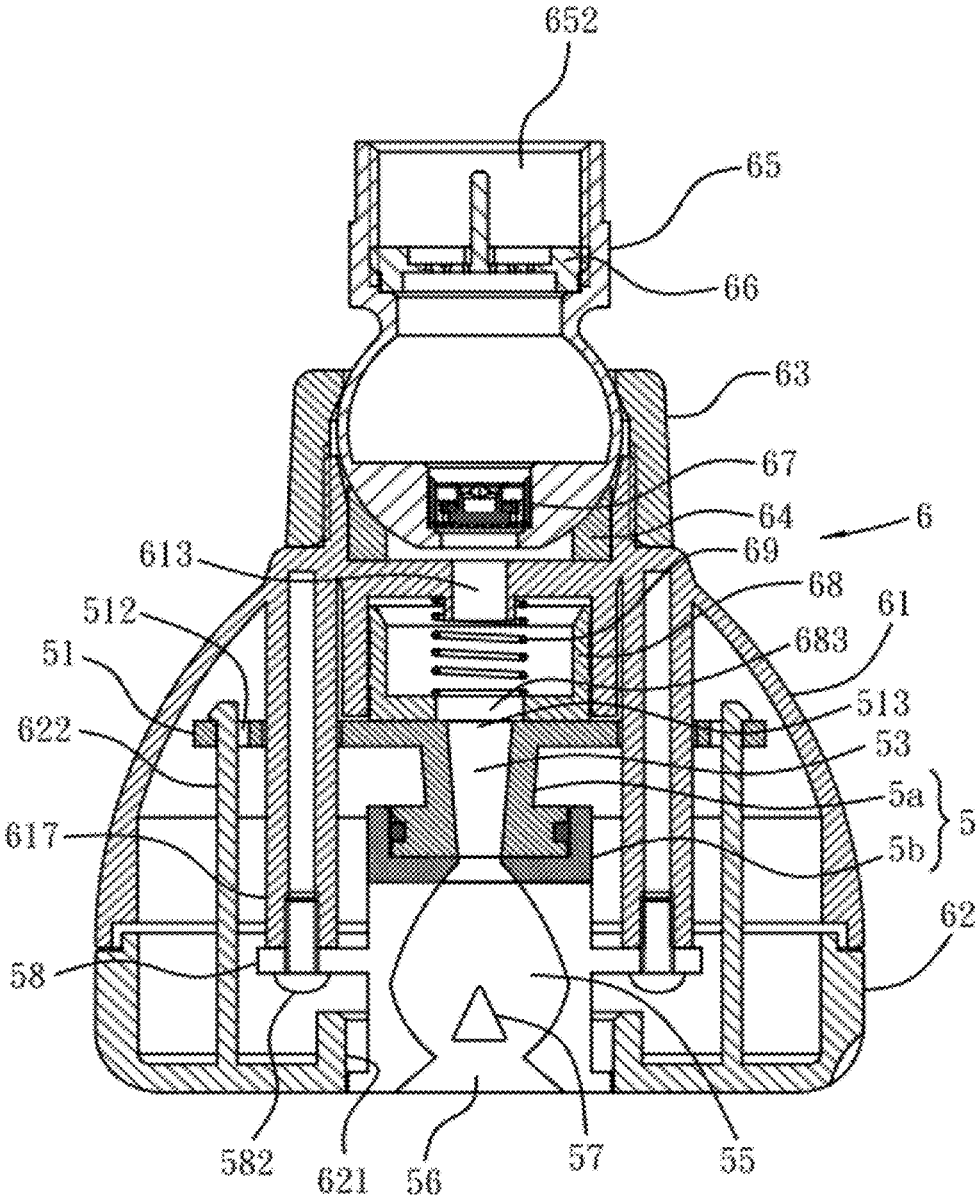
FIG. 24 is a cross sectional view showing the assembly of the fluid spraying device in accordance with the fifth embodiment of the present invention.

The fluid oscillator 5 is used in a shower head 6, and the shower head 6 includes a housing 61, a cover 62, a lip 63, a rotating pad 64, a connecting head 65, a filtering mesh 66, a dynamic flow controller 67, an oil seal 68, and a spring 69, wherein the housing 61 is formed in a bell shape, and as illustrated in FIG. 23, the housing 61 includes a screwing head 611 fixed on a top end thereof and a groove 612 attached therein, the groove 612 includes a passageway 613 communicating with a central portion of a bottom wall thereof, and includes a peripheral wall 614 extending around the bottom end thereof to define a positioning trench 615.

The passageway 613 includes a retaining rim 616 mounted on a bottom end thereof, and the housing 61 includes two supports 617 disposed around the peripheral wall 614, and each support 617 includes a screw aperture 618 fixed on a distal end thereof so that the supporting members 58 of the second portion 5*b* are locked to the supports 617 of the housing 61 by using bolts 582. The first portion 5*a* passes through the supports 617 by ways of the arcuate notches 511 so that the second portion 5*b* rotates, and the supports 617 slide in the arcuate notches 511 so that the first and the second portions 5*a* and 5*b* rotate smoothly.

The cover 62 is fixed on a lower side of the housing 61 to be operated to rotate, and includes a hollow opening 621 secured at a central portion thereof to receive the second portion 5*b* of the fluid oscillator 5 so that the outlet 56 communicates with an external environment. The cover 62 further includes four engaging pieces 622 extending upward to be retained in the retaining bores 512 of the first portion 5*a* so that the cover 62 connects with the first portion 5*a*. When the cover 62 is rotated, the first portion 5*a* and the second portion 5*b* of the fluid oscillator 5 are actuated to rotate between a normal position and an adjusting position, and the first channel 53*a* of the first portion 5*a* of the power nozzle 53 crosses with the second channel 53*b* of the second portion 5*b* to change a connection of the power nozzle 53 to flow water through the cross sectional area A, hence the fluid will spray from the outlet 56 and be adjusted easily by rotating the cover 62.

The lip 63 is screwed with the screwing head 611 of the housing 61.

The rotating pad 64 is received in the groove 612 of the screwing head 611 of the housing 61.

The connecting head 65 is coupled to an outputting pipe by using its top end and includes a spherical member 651 disposed on a bottom end thereof to be retained between the lip 63 and the groove 612 of the housing 61, and includes a tunnel 652 formed therein to flow fluid.

The filtering mesh 66 is installed on an upper end of the tunnel 652 of the connecting head 65 to filter fluid.

The dynamic flow controller 67 is installed on a lower end of the tunnel 652 of the connecting head 65 to limit fluid. Because the dynamic flow controller 67 is well known, further description is omitted.

The oil seal 68 is installed in the positioning trench 615 of the housing 61, and includes a peripheral side 681 to engage with the positioning trench 615, and includes a bottom end 682 engaging with the power nozzle 53 of the first portion 5*a* tightly, the bottom end 682 includes a pore 683 passing through a central portion thereof and communicating with an opening of the power nozzle 53, a diameter of the pore 683 is more than that of the opening of the power nozzle 53.

The spring 69 includes one end positioned on the retaining rim 616 of the positioning trench 615, and includes another end abutting against the bottom end 682 of the pore 683 of the oil seal 68 so that the oil seal 68 engages with the first portion 5*a* tightly.

In operation of the shower head 6, the fluid flows into the tunnel 652 of the connecting head 65 of the shower head 6 through the outputting pipe, and then flows through the filtering mesh 66, the dynamic flow controller 67, the passageway 613 of the housing 61, and the pore 683 of the oil seal 68 to flow into the power nozzle 53 of the fluid oscillator 5 to accelerate flowing speed so as to further flow to the chamber 55, such that the fluid is oscillated to spray out of the outlet 56, generating different showing effect, wherein the user allows to rotate the cover 62 to actuate the first portion 5*a* of the fluid oscillator 5 rotate relative to the second portion 5*b* to change the cross sectional area A of the connection of the first and the second portions 5*a*, 5*b*, controlling the amount of fluid from the outlet 56, therefore the spraying water is controlled at a specific oscillating angel and direction to save water.

The fluid oscillator 5 of the showering head 6 is rotated relative to the second portion 5*b* by operating the cover 62 to actuate the first portion 5*a*, but it can be designed to be rotated relative to the first portion 5*a* by the second portion 5*b* so as to adjust flowing amount. Of course, as the second portion 5*b* is rotated, the outlet 56 rotates relatively to change oscillating direction, thus adjusting water and oscillating direction.

The oscillating bodies 1-5 match with sole power nozzle 12, 23, 31, 42, 53 respectively, but also cam match with at least two power nozzles. Besides, the oscillating bodies 1-5 can be assembled to form a fluid spraying device.

While we have shown and described various embodiments in accordance with the present invention, it is clear to those skilled in the art that further embodiments may be made without departing from the scope of the present invention.

What is claimed is:

1. A fluid spraying device comprising a fluid oscillator being used to oscillate fluid to generate spraying water and including:

an inlet to flow fluid into the fluid oscillator;

at least one power nozzle communicating with the inlet to accelerate the speed of the fluid from the inlet;

an interacting chamber communicating with the power nozzle to flow the fluid from the power nozzle and further flow the fluid outward to be oscillated;

an outlet being in communication with the chamber to oscillate the fluid from the chamber to generate spraying water, characterized in that:

the fluid oscillator includes a first portion and a second portion;

a connection of the first and the second portions passes through the power nozzle to flow fluid through a predetermined traveling position, and the first portion includes the inlet and a section of the power nozzle, and the second portion includes the outlet and another section of the power nozzle, by using a movement of the first and the second portions, a cross sectional area of the fluid at the connection of the first and the second portions is changed to adjust spraying water from the outlet;

wherein the first portion rotates relative to the second portion.

2. The fluid spraying device as claimed in claim 1, wherein the first and the second portions rotate relative to each other between a normal position and at least one adjusting position; at the normal position, a first flowing zone of the first portion and a second flowing zone of the second portion align with each other so that a cross sectional area of the fluid at a connection of the first and the second portions is largest; at the adjusting position, the first flowing zone of the first portion and the second flowing zone of the second portion cross with each other so that the cross sectional area of the fluid at the connection of the first and the second portions is less than that of the fluid at the connection of the first and the second portions at the normal position.

3. The fluid spraying device as claimed in claim 1, wherein a cross section of the power nozzle is formed in a rectangle shape.

4. The fluid spraying device as claimed in claim 1, wherein each of the first and the second portions includes a connecting plane, the connecting planes of the first and the second portions pass through a middle section of the power nozzle, and the first portion includes the inlet and a first flowing zone above the connecting plane thereof.

5. The fluid spraying device as claimed in claim 4, wherein the second portion is comprised of a first part and a second part, the first part includes an engaging recess arranged on a top end thereof to engage a positioning peg of the first portion tightly, and the positioning peg is located in the engaging recess to rotate; the first and the second parts include two recessed surfaces formed on inner walls thereof respectively to define the chamber with a first space and the outlet, and the first part includes a second channel aligning with a first channel to form the power nozzle, the second channel communicates with a second space so that the first space and the second space form a complete chamber.

6. The fluid spraying device as claimed in claim 5, wherein a recessed surface of the second part includes a triangle projection proximate to the outlet to abut against a recessed surface of the first part, so as to define a stop member.

7. The fluid spraying device as claimed in claim 1 further comprising a housing, a cover, and a connecting head, wherein the housing includes a passageway communicating with a central portion of a bottom wall thereof, the cover is fixed on a lower side of the housing to be operated to rotate, and includes a hollow opening defined on a central portion thereof, the connecting head is installed to a top end of the housing to couple with an outputting pipe and to flow fluid to the housing, the fluid oscillator is installed between the housing and the cover, and the inlet communicates with the housing, the outlet communicates with an external environment through the hollow opening, the second portion connects with the housing, and the first portion couples with the cover to be actuated by the cover to rotate along the second portion.

8. The fluid spraying device as claimed in claim 7, wherein a first part and a second part of the second portion each includes two ribs disposed on two outer sides thereof respectively, and the first and the second parts are assembled to generate a supporting member having two through holes, and the housing includes two supports disposed around a peripheral wall, and each support includes a screw aperture fixed on a distal end thereof so that the supporting members of the second portion are locked to the supports of the housing by using bolts; the first portion includes a circular disc having two arcuate notches symmetrical to each other and a plurality of retaining bores located around the arcuate notches, the arcuate notches are used to receive the supports; the cover further includes a number of engaging pieces extending upward to be retained in the retaining bores of the first portion.

9. The fluid spraying device as claimed in claim 7, wherein the first portion includes a positioning peg extending from a bottom end thereof, the second portion includes an engaging recess arranged on a top end thereof to engage with the positioning peg of the first portion tightly, and the positioning peg is located in the engaging recess to rotate.

10. The fluid spraying device as claimed in claim 9, wherein the second portion is comprised of a first part and a second part, the first part includes an engaging recess arranged on a top end thereof to engage the positioning peg of the first portion tightly, and the positioning peg is located in the engaging recess to rotate; the first and the second parts include two recessed surfaces formed on inner walls thereof respectively to define the chamber with a first space and the outlet, and the first part includes a second channel aligning with a first channel to form the power nozzle, the second channel communicates with a second space so that the first space and the second space form a complete chamber.

11. The fluid spraying device as claimed in claim 10, wherein the recessed surface of the second part includes a triangle projection proximate to the outlet to abut against the recessed surface of the first part, so as to define a stop member.

12. The fluid spraying device as claimed in claim 10, further comprising an oil seal and a spring, wherein the oil seal is installed in a positioning trench of the housing, and includes a peripheral side to engage with the positioning trench, and includes a bottom end engaging with the power nozzle of the first portion tightly, the bottom end includes a pore passing through a central portion thereof and communicating with an opening of the power nozzle, a diameter of the pore is more than that of the opening of the power nozzle; the spring includes one end positioned on a retaining rim of the positioning trench, and includes another end abutting against the bottom end of the pore of the oil seal so that the oil seal engages with the first portion tightly.

13. The fluid spraying device as claimed in claim 7 further comprising a lip and a rotating pad, wherein the lip is screwed with a screwing head of the housing, and the rotating pad is received in a groove of the screwing head of the housing.

14. A fluid spraying device comprising a fluid oscillator being used to oscillate fluid to generate spraying water and including:

an inlet to flow fluid into the fluid oscillator;

at least one power nozzle communicating with the inlet to accelerate the speed of the fluid from the inlet;

an interacting chamber communicating with the power nozzle to flow the fluid from the power nozzle and further flow the fluid outward to be oscillated;

an outlet being in communication with the chamber to oscillate the fluid from the chamber to generate spraying water;

a flow adjusting means to change the power nozzle at a predetermined traveling position so as to change a cross sectional area of fluid at a connection of a first portion and a second portion of the fluid oscillator, thereby adjusting spraying water from the outlet.

15. The fluid spraying device as claimed in claim 14, wherein the first and second portions move relative to each other between a normal position and at least one adjusting position; at the normal position, a first flowing zone of the first portion and a second flowing zone of the second portion align with each other so that a cross sectional area of the fluid at the connection of the first and the second portions is largest; at the adjusting position, the first flowing zone of the first portion and the second flowing zone of the second portion cross with each other so that the cross sectional area of the fluid at the connection of the first and the second portions is changed.

16. The fluid spraying device as claimed in claim 15 further comprising a housing, a cover, and a connecting head, wherein the housing includes a passageway communicating with a central portion of a bottom wall thereof, the cover is fixed on a lower side of the housing to be operated to rotate, and includes a hollow opening defined on a central portion thereof, the connecting head is installed to a top end of the housing to couple with an outputting pipe and to flow fluid to the housing, the fluid oscillator is installed between the housing and the cover, and the inlet communicates with the housing, the outlet communicates with an external environment through the hollow opening, the second portion connects with the housing, and the first portion couples with the cover to be actuated by the cover to rotate along the second portion.

17. The fluid spraying device as claimed in claim 16, wherein a first part and a second part of the second portion each includes two ribs disposed on two outer sides thereof respectively, and the first and the second parts are assembled to generate a supporting member having two through holes, and the housing includes two supports disposed around a peripheral wall, and each support includes a screw aperture fixed on a distal end thereof so that the supporting members of the second portion are locked to the supports of the housing by using bolts; the first portion includes a circular disc having two arcuate notches symmetrical to each other and a plurality of retaining bores located around the arcuate notches, the arcuate notches are used to receive the supports; the cover further includes a number of engaging pieces extending upward to be retained in the retaining bores of the first portion.

* * * * *